US012262734B2

(12) United States Patent
Jeoung et al.

(10) Patent No.: US 12,262,734 B2
(45) Date of Patent: Apr. 1, 2025

(54) AEROSOL GENERATING ARTICLE AND SYSTEM COMPRISING COMPOSITE HEAT SOURCE

(71) Applicant: KT&G CORPORATION, Daejeon (KR)

(72) Inventors: Eun Mi Jeoung, Daejeon (KR); Sung Jong Ki, Daejeon (KR); Young Joong Kim, Daejeon (KR); In Su Park, Seoul (KR); John Tae Lee, Daejeon (KR); Sun Hwan Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 723 days.

(21) Appl. No.: 17/421,124

(22) PCT Filed: Jan. 6, 2021

(86) PCT No.: PCT/KR2021/000112
§ 371 (c)(1),
(2) Date: Jul. 7, 2021

(87) PCT Pub. No.: WO2021/167240
PCT Pub. Date: Aug. 26, 2021

(65) Prior Publication Data

US 2022/0322736 A1 Oct. 13, 2022

(30) Foreign Application Priority Data

Feb. 17, 2020 (KR) ..... 10-2020-0019083

(51) Int. Cl.
*A24D 1/22* (2020.01)
*A24D 1/02* (2006.01)
*C10L 11/04* (2006.01)

(52) U.S. Cl.
CPC ..... *A24D 1/22* (2020.01); *A24D 1/02* (2013.01); *C10L 11/04* (2013.01);
(Continued)

(58) Field of Classification Search
None
See application file for complete search history.

(56) References Cited

U.S. PATENT DOCUMENTS 5,240,012 A 8/1993 Ehrman et al.
5,443,560 A 8/1995 Deevi et al.
(Continued)

FOREIGN PATENT DOCUMENTS

CN 104203013 A 12/2014
CN 104486957 A * 4/2015
(Continued)

OTHER PUBLICATIONS

English language machine translation of KR20140093659A, 2014.*
(Continued)

*Primary Examiner* — Katherine A Will
*Assistant Examiner* — Michael T Fulton
(74) *Attorney, Agent, or Firm* — Sughrue Mion, PLLC

(57) ABSTRACT

An aerosol generating article and an aerosol generating system, which include a composite heat source, are provided. An aerosol generating article includes: a first portion including a composite heat source; a second portion adjacent to the first portion and including at least one of an aerosol generating material and a tobacco material; a third portion including a cooling material; and a fourth portion including a filter material, wherein the first portion, the second portion, the third portion, and the fourth portion are sequentially arranged along a longitudinal direction of the aerosol generating article.

8 Claims, 6 Drawing Sheets

(52) U.S. Cl.
CPC ..... *C10L 2200/0213* (2013.01); *C10L 2200/0254* (2013.01); *C10L 2230/06* (2013.01); *C10L 2270/08* (2013.01)

(56) References Cited

U.S. PATENT DOCUMENTS

| | | | | |
|---|---|---|---|---|
| 6,598,607 | B2 | 7/2003 | Adiga et al. | |
| 8,430,106 | B2 | 4/2013 | Potter et al. | |
| 9,629,393 | B2 | 4/2017 | Stolz et al. | |
| 10,375,989 | B2 | 8/2019 | Borges De Couraca et al. | |
| 10,729,169 | B2 | 8/2020 | Malgat | |
| 11,213,064 | B2 | 1/2022 | Roudier et al. | |
| 2015/0007837 | A1 | 1/2015 | Roudier et al. | |
| 2016/0331028 | A1* | 11/2016 | Xu | A24F 42/60 |
| 2017/0238607 | A1 | 8/2017 | Nordskog | |
| 2017/0318859 | A1 | 11/2017 | Batista | |
| 2018/0279672 | A1* | 10/2018 | Davis | A24F 40/46 |
| 2019/0014820 | A1 | 1/2019 | Malgat | |
| 2019/0029315 | A1 | 1/2019 | Malgat | |
| 2019/0075845 | A1 | 3/2019 | Malgat et al. | |
| 2021/0068469 | A1 | 3/2021 | Ademe | |

FOREIGN PATENT DOCUMENTS

| | | | | | |
|---|---|---|---|---|---|
| CN | 107105760 | A | | 8/2017 | |
| CN | 107920596 | A | | 4/2018 | |
| CN | 108366618 | A | | 8/2018 | |
| EP | 0 354 661 | A2 | | 2/1990 | |
| JP | 2004-208678 | A | | 7/2004 | |
| JP | 2015-507934 | A | | 3/2015 | |
| JP | 2018-531594 | A | | 11/2018 | |
| KR | 10-0161278 | B1 | | 8/1998 | |
| KR | 10-2009-0046820 | A | | 5/2009 | |
| KR | 20100108565 | A | * | 10/2010 | |
| KR | 10-2014-0093659 | A | | 7/2014 | |
| KR | 20140093659 | A | * | 7/2014 | |
| KR | 10-2014-0130130 | A | | 11/2014 | |
| KR | 10-2017-0020342 | A | | 2/2017 | |
| KR | 10-2018-0093030 | A | | 8/2018 | |
| KR | 10-2018-0118767 | A | | 10/2018 | |
| KR | 10-2018-0122365 | A | | 11/2018 | |
| WO | WO-2013124357 | A1 | * | 8/2013 | A24B 15/165 |
| WO | 2016/156424 | A1 | | 10/2016 | |
| WO | 2017/207585 | A1 | | 12/2017 | |

OTHER PUBLICATIONS

English language machine translation of KR20100108565A, 2010.*
English language machine translation of CN104486957A, 2015.*
Extended European Search Report issued Jan. 31, 2022 in European Application No. 21735837.3.
International Search Report of PCT/KR2021/000112 dated Apr. 9, 2021 [PCT/ISA/210].
Written Opinion of PCT/KR2021/000112 dated Apr. 9, 2021 [PCT/ISA/237].
Japanese Office Action dated Oct. 4, 2022 in Japanese Application No. 2021-539563.
Office Action dated Apr. 7, 2022, issued in Korean Application No. 10-2020-0019083.
Office Action issued Apr. 11, 2023 in Chinese Application No. 202180001803.7.

* cited by examiner

AEROSOL GENERATING ARTICLE AND SYSTEM COMPRISING COMPOSITE HEAT SOURCE

CROSS REFERENCE TO RELATED APPLICATIONS

This application is a National Stage of International Application No. PCT/KR2021/000112, filed Jan. 6, 2021, claiming priority to Korean Patent Application No. 10-2020-0019083, filed Feb. 17, 2020.

TECHNICAL FIELD

The disclosure relates to an aerosol generating article including a composite heat source.

BACKGROUND ART

Recently, the demand for alternative methods to overcome the disadvantages of traditional cigarettes has increased. For example, research has been actively performed on technology for generating aerosols by delivering heat to an aerosol generating substrate that is physically separated from a combustible heat source.

However, it takes time until the combustible heat source is ignited and delivers the heat to the aerosol generating substrate.

DESCRIPTION OF EMBODIMENTS

Technical Problem

An aerosol generating article according to embodiments may overcome technical shortcomings of the related art.

However, technical problems are not limited thereto, and other technical problems may be derived from the following examples.

Solution to Problem

A first aspect of the present disclosure may provide an aerosol generating article, including: a first portion including a composite heat source, a second portion adjacent to the first portion and including at least one of an aerosol generating material and a tobacco material; a third portion including a cooling material; and a fourth portion including a filter material, wherein the first portion, the second portion, the third portion, and the fourth portion are sequentially arranged with reference to a longitudinal direction of the aerosol generating article, and the composite heat source includes a combustible heat source and a combustible wick inserted into the combustible heat source.

Advantageous Effects of Disclosure

According to embodiments, heat generated by a composite heat source may be efficiently transferred to an aerosol generating substrate.

Effects of the disclosure are not limited thereto, and may include all effects that may be derived from the following configurations.

BEST MODE

Figure 1:
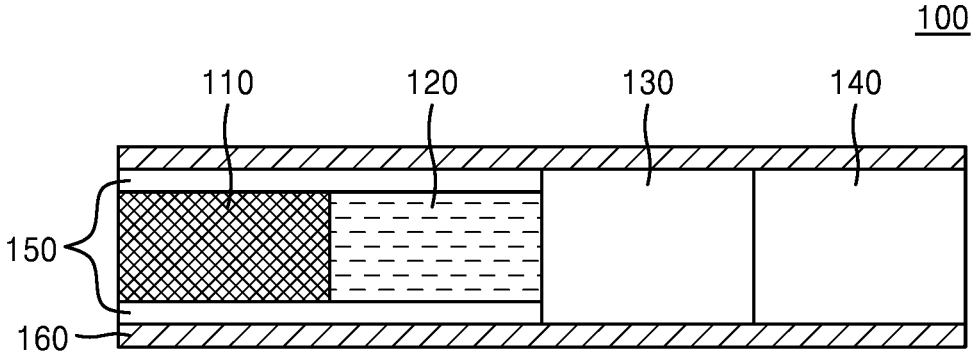
FIG. 1 is a schematic diagram of a configuration of an aerosol generating article according to embodiments.

A first aspect of the disclosure may provide an aerosol generating article, including: a first portion including a composite heat source; a second portion adjacent to the first portion and including at least one of an aerosol generating material and a tobacco material; a third portion including a cooling material; and a fourth portion including a filter material, wherein the first portion, the second portion, the third portion, and the fourth portion are sequentially arranged along a longitudinal direction of the aerosol generating article, and the composite heat source includes a combustible heat source, and a combustible wick inserted into the combustible heat source.

In an embodiment, the combustible wick may include a combustible body soaked with alcohol, a solid fuel, or a metal wire.

In an embodiment, when the first portion is combusted, a combustion rate of the combustible wick may be greater than a combustion rate of the combustible heat source.

In an embodiment, when the first portion is combusted, the combustible wick may be removed, and an air flow passage may be formed in the combustible heat source.

In an embodiment, the aerosol generating article may further include a first wrapper surrounding the first portion and the second portion.

In an embodiment, the combustible wick is coaxially arranged in a central portion of the combustible heat source, and the combustible wick may have a uniform diameter in a longitudinal direction of the aerosol generating article.

In an embodiment, the combustible wick includes a first region and a second region, the first region and the second region being physically connected to each other, and the first region may have a uniform diameter in the longitudinal direction of the aerosol generating article, and the second region may have a diameter increasing in the longitudinal direction of the aerosol generating article.

In an embodiment, the combustible wick may include magnesium ribbon.

A second aspect of the disclosure may provide an aerosol generating system, in which an aerosol is generated by ignition of the first portion of the aerosol generating article according to the first aspect.

In an embodiment, the combustible wick may include a combustible body soaked with alcohol, a solid fuel, or a metal wire.

In an embodiment, a combustion rate of the combustible wick may be greater than a combustion rate of the combustible heat source.

In an embodiment, the combustible wick may be removed, and an air flow passage may be formed in the combustible heat source.

A third aspect of the inventive concept may provide a composite heat source for the aerosol generating article, including: a combustible heat source; and a combustible wick inserted into the combustible heat source, wherein the combustible wick may provide a composite heat source including a combustible body soaked with alcohol, a solid fuel, or a metal wire.

In an embodiment, when the composite heat source is combusted, a combustion rate of the combustible wick may be greater than a combustion rate of the combustible source.

MODE OF DISCLOSURE

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, "A and/or B" indicates at least any one of A and B.

Throughout the specification, "on-" indicates that a component is on a surface of another component, and also includes cases in which the component contacts the other component or the component is above the other component without contact.

Throughout the specification, "a longitudinal direction of an aerosol generating article" indicates a direction in which a length of the aerosol generating article extends or a direction in which combustion proceeds when the aerosol generating article is combusted.

Hereinafter, embodiments of the disclosure will be described in detail with reference to the accompanying drawings.

FIG. 1 is a schematic diagram of a configuration of an aerosol generating article 100 according to embodiments.

According to a first aspect of the disclosure, there is provided the aerosol generating article 100 including a first portion 110 that includes a composite heat source, a second portion 120 that is adjacent to the first portion 110 and includes at least one of an aerosol generating material and a tobacco material, a third portion 130 including a cooling material, and a fourth portion 140 including a filter material. Also, in some embodiments, the aerosol generating article 100 may further include a first wrapper 150 and a second wrapper 160.

Referring to FIG. 1, the first portion 110, the second portion 120, the third portion 130, and the fourth portion 140 may be sequentially arranged along a longitudinal direction of the aerosol generating article 100. Heat generated from the composite heat source arranged in the first portion 110 may be delivered to the second portion 120. Aerosol generated from the second portion 120 due to the heat may be delivered to a user through the third portion 130 and the fourth portion 140.

The first portion 110 may include the composite heat source. As it will be described detail in FIGS. 2A and 2B, the composite heat source according to embodiments may include a combustible heat source and a combustible wick. The combustible heat source may include a heat source including carbon. The combustible wick may include a combustible body soaked with alcohol, a solid fuel, or a metal wire. In addition, the composite heat source may be included in the aerosol generating article, and as the heat generated due to the composite heat source is delivered to an aerosol generating material in the aerosol generating article, aerosol may be generated.

The second portion 120 may be adjacent to the first portion 110. For example, the first portion 110 may be at an upstream of the aerosol generating article 100, and compared to the first portion 110, the second portion 120 may be at a downstream of the aerosol generating article 100.

Here, regarding the terms "upstream" and "downstream", when a user puffs air by using the aerosol generating article, a portion into which the air flows from the outside of the aerosol generating article is "upstream", and a portion from which the air flows to the outside of the aerosol generating article is "downstream". The terms "upstream" and "downstream" are used to indicate relative positions or directions of portions or segments included in the aerosol generating article.

The second portion 120 may include at least one of the aerosol generating material and the tobacco material. The tobacco material may include, for example, at least one of shredded pipe tobacco, reconstituted pipe tobacco leaves, tobacco leaves, expanded tobacco, and nicotine extract. The tobacco material may include nicotine. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto.

For example, the second portion 120 may include the reconstituted pipe tobacco leaves soaked with glycerin. When the composite heat source of the first portion 110 is ignited, the heat generated from the first portion 110 may be delivered to the second portion 120, and the aerosol may be generated from the reconstituted pipe tobacco leaves soaked with glycerin. However, the disclosure is not necessarily limited to the descriptions.

The third portion 130 may include the cooling material, which cools an air flow that passes through the first portion 110 and the second portion 120. The third portion 130 may include a polymer material or a biodegradable polymer material, configured to cool the aerosol. For example, the third portion 130 may include pure polylactic acid alone, but the material for forming the cooling segment is not limited thereto.

In some embodiments, the third portion 130 may include a cellulose acetate filter having a plurality of holes. However, the third portion 130 is not limited to the above-described example and is not limited as long as the cooling segment cools the aerosol. For example, the third portion 130 may include a tube filter or a base paper filter that includes a hollow.

The fourth portion 140 may include a cellulose acetate filter. Shapes of the fourth portion 140 are not limited. For example, the fourth portion 140 may include a cylinder-type rod or a tube-type rod having a hollow inside. Also, the fourth portion 140 may include a recess-type rod. When the fourth portion 140 includes a plurality of segments, at least one of the plurality of segments may have a different shape.

The fourth portion 140 may be formed to generate flavors. For example, a flavoring liquid may be injected onto the fourth portion 140, or an additional fiber coated with a flavoring liquid may be inserted into the fourth portion 140.

In embodiments, the first portion 110 may have a length from about 8 mm to about 12 mm, and the second portion 120 may have a length from about 10 mm to about 14 mm. However, the disclosure is not necessarily limited to the descriptions.

The aerosol generating article 100 may further include at least one of the first wrapper 150 and the second wrapper 160.

The first wrapper 150 may surround the first portion 110 and the second portion 120. The first wrapper 150 may include, for example, a heat-conductive wrapper. Desirably, the first wrapper 150 may include an aluminum thin film. When the first portion 110 is ignited and combusted, the heat generated from the first portion 110 may be directly delivered to the second portion 120, and the heat generated from the first portion 110 may also be delivered to the second portion 120 through the first wrapper 150. The first wrapper 150 may have, for example, a heat conductivity from about 50 $W \cdot m^{-1}/K^{-1}$ to about 500 $W \cdot m^{-1}/K^{-1}$.

The second wrapper 160 may surround the first portion 110, the second portion 120, the third portion 130, and the fourth portion 140. The second wrapper 160 may include, for example, a sheet of cellulose paper. However, the disclosure is not necessarily limited thereto.

In addition, the aerosol generating article 100 may further include a barrier (not shown) arranged between the first portion 110 and the second portion 120. The barrier may reduce transfer of harmful gas, which is generated from the first portion 110, to the second portion 120, the third portion 130, or the fourth portion 140. The barrier may include, for example, a metal material. Accordingly, the user may puff required components alone in the form of aerosol.

Figure 2A:
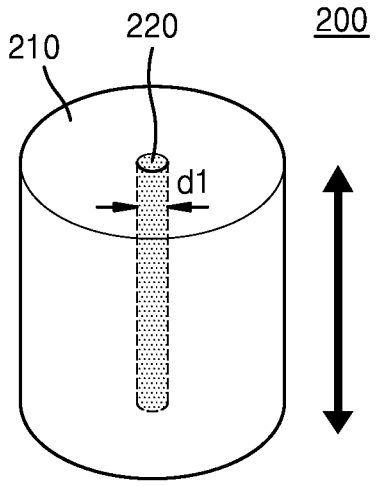
FIG. 2A is a diagram of a configuration of a composite heat source according to an embodiment.

FIG. 2A is a diagram of a configuration of a composite heat source 200 according to an embodiment.

In embodiments, the composite heat source 200 may have a cylinder shape. However, the shape of the composite heat source 200 is not necessarily limited to the descriptions, and the disclosure may include all of well-known shapes in the field.

The composite heat source 200 may include a combustible heat source 210 and a combustible wick 220.

The combustible heat source 210 may include, for example, a heat source including carbon.

The combustible wick 220 may include a combustible body soaked with alcohol, a solid fuel, or a metal wire. The combustible body soaked with alcohol may include, for example, yarn, thread, paper, woodstick, or the like soaked with ethanol. The solid fuel may include, for example, an ignition support material such as solid methyl alcohol. The metal wire may include, for example, a magnesium ribbon. The combustible wick 220 may have a combustion rate that is greater than that of the combustible heat source 210. In addition, the combustible wick 220 may support ignition or combustion of the combustible heat source 210. The combustible wick 220 may be removed during combustion.

The combustible wick 220 may be inserted into a center portion of the combustible heat source 210. To allow the combustible wick 220 to be inserted into the center portion of the combustible heat source 210, a passage extending in a longitudinal direction of the aerosol generating article may be formed in the center portion of the combustible heat source 210. The combustible wick 220 may be coaxially arranged in the center portion of the combustible heat source 210.

The combustible wick 220 may have a diameter d1. For example, the diameter d1 of the combustible wick 220 may be from about 1/10 to about 1/2 of the diameter of the composite heat source 200. By adjusting the diameter d1 of the combustible wick 220, a weight of the solid fuel or the metal wire included in the composite heat source may be adjusted.

Referring to FIG. 2A, the combustible wick 220 may have the diameter d1, which is uniform, in the longitudinal direction of the aerosol generating article or a longitudinal direction of the composite heat source 200. As it will be described later, when the composite heat source 200 is combusted, the combustible wick 220 is combusted and removed, and therefore, after a certain time period, an air flow passage may be formed in a center portion of the composite heat source 200. When external air is introduced through the air flow passage, combustion of the combustible heat source 210 may be further promoted.

Figure 2B:
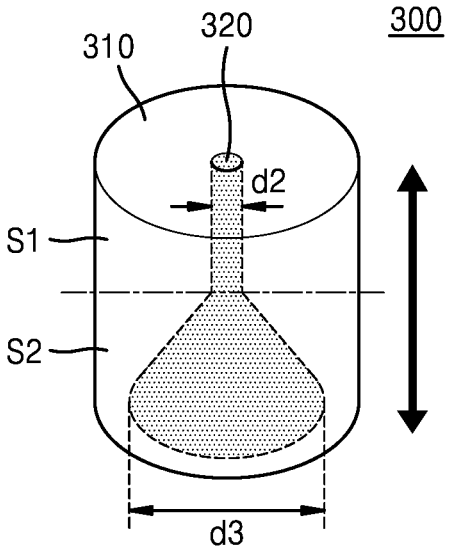
FIG. 2B is a diagram of a configuration of a composite heat source according to another embodiment.

FIG. 2B is a diagram of a configuration of a composite heat source 300 according to another embodiment.

The descriptions of FIGS. 1 and 2A may be equally applied to FIG. 2B. However, unlike in FIG. 2A, the composite heat source 300 in FIG. 2B may include a first region S1 and a second region S2 according to a diameter of the combustible wick 320.

The composite heat source 300 may include a combustible heat source 310 and the combustible wick 320. The combustible wick 320 may be inserted into a center portion of the combustible heat source 310.

In the embodiment shown in FIG. 2B, the composite heat source 300 may be divided into the first region S1 and the second region S2. The first region S1 and the second region S2 may be physically connected to each other.

The first region S1 may have a diameter d2, which is uniform, in the longitudinal direction of the aerosol generating article. On the contrary, the second region S2 may have a diameter d3 increasing in the longitudinal direction of the aerosol generating article. Accordingly, the diameter d3 may be equal to or greater than the diameter d2.

As the diameter d3 of the second region S2 is equal to or greater than the diameter d2, the composite heat source 300 according to the embodiment in FIG. 2B may include a greater number of combustible wicks 320 compared to the composite heat source 200 according to the embodiment in FIG. 2A. Accordingly, combustion of the composite heat source 300 according to the embodiment in FIG. 2B may be promoted.

In addition, when the composite heat source 300 is ignited and combusted, a combustion rate of the combustible wick 320 may be greater than a combustion rate of the combustible heat source 310. In addition, the combustible wick 320 may be ignited, combusted, and removed. In the embodiment of FIG. 2B, the combustible wick 320 may be removed, and an air flow passage may be formed in the center portion of the combustible heat source 310. Accordingly, the air flow passage may broaden from the first region S1 to the second region S2. Accordingly, air may be more easily introduced from the outside of the aerosol generating article to the inside thereof. In addition, a surface area of the combustible heat source 310 contacting the external air further increases, and thus, combustion of the combustible heat source 310 may be further promoted.

Figure 3A:
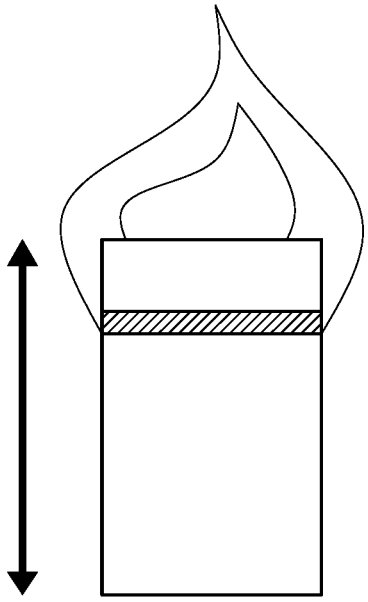
FIG. 3A is a diagram showing a state in which a combustible heat source is ignited and starts burning.

FIG. 3A is a diagram showing a state in which a combustible heat source is ignited and starts combustion.

Referring to FIG. 3A, it may be seen that, when the combustible heat source that does not include a combustible wick is ignited, an end portion of the combustible heat source is mainly combusted. In this case, as only a local portion of the combustible heat source is combusted, heat may not be efficiently delivered to other portions of the aerosol generating article. In addition, an air flow passage is also not formed during combustion.

Figure 3B:
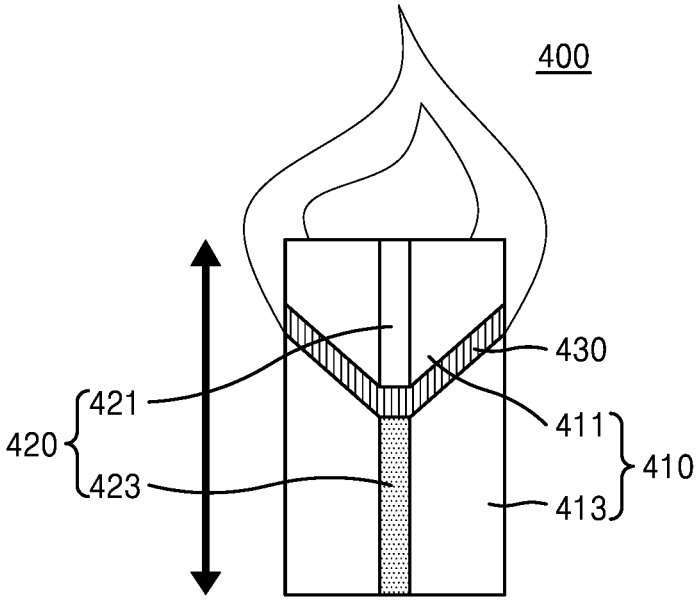
FIG. 3B is a diagram showing a state in which a composite heat source according to an embodiment is ignited and starts burning.

FIG. 3B is a diagram showing a state in which a composite heat source 400 according to an embodiment is ignited and starts combustion.

For example, the composite heat source 400 in FIG. 3B may be the composite heat source 200 in FIG. 2A.

The composite heat source 400 may include a combustible heat source 410 and a combustible wick 420. After the composite heat source 400 is ignited and combusted to a certain degree, the combustible heat source 410 and the combustible wick 420 may be partially or entirely combusted and removed. As a combustion rate of the combustible wick 420 is greater than a combustion rate of the combustible heat source 410, it may be seen that a combustion portion in a center portion of the combustible heat source 410 is formed in a greater depth compared to other portions.

In detail, the composite heat source 400 may be divided into a region 411 in which a combustible heat source is combusted, a region 413 in which the combustible heat source is not combusted, a region 430 in which the combustible heat source is overheated, a region 421 in which the combustible wick is combusted, and a region 423 in which the combustible wick is not combusted.

As the external air is introduced into the region 421 in which the combustible wick is combusted, a surface area of the combustible heat source 410 contacting the external air increases, and accordingly, combustion of the combustible heat source 410 may be promoted.

Figure 3C:
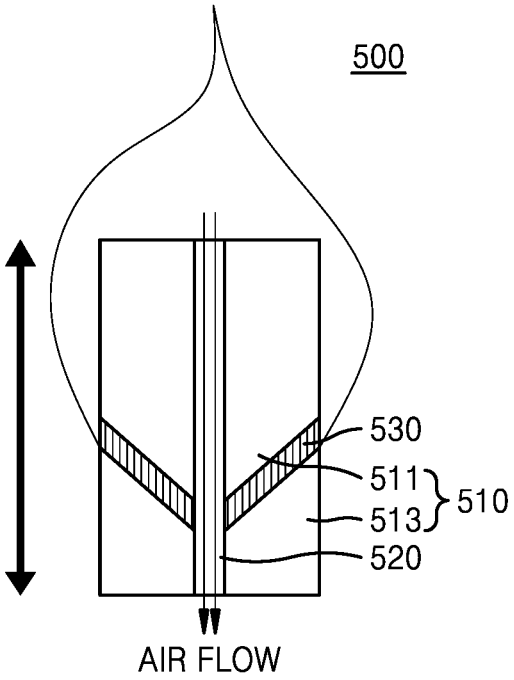
FIG. 3C is a diagram showing a state in which a composite heat source according to an embodiment has been combusted to a certain degree.

FIG. 3C is a diagram showing a state in which a composite heat source 500 according to an embodiment is combusted to a certain degree.

For example, the composite heat source 500 in FIG. 3C may be the composite heat source 200 in FIG. 3A.

However, when the composite heat source 500 is combusted to a certain degree, the combustible wick may be completely combusted, and an air flow passage 520 may be formed. Accordingly, the composite heat source 500 may include a combustible heat source 510 and the air flow passage 520.

In the embodiment, as the air flow passage 520 is formed, a surface area of the combustible heat source 510 contacting the external air increases, and thus, combustion of the combustible heat source 510 may be promoted. In addition, when a user puffs aerosol through a fourth portion (not shown), the external air may be more easily introduced into the aerosol generating article.

A second aspect of the disclosure may provide an aerosol generating system, in which a first portion of the aerosol generating article according to the first aspect is ignited and aerosol is generated.

The descriptions of the first aspect may be equally applied to the second aspect of the disclosure.

In addition, a third aspect of the disclosure may provide a composite heat source for the aerosol generating article, the composite heat source including a combustible heat source and a combustible wick inserted into the combustible heat source, wherein the combustible wick includes a combustible body soaked with alcohol, a solid fuel, or a metal wire.

The descriptions of the first aspect and the second aspect may be equally applied to the third aspect of the disclosure.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating article comprising:

a first portion comprising a composite heat source;

a second portion adjacent to the first portion and comprising at least one of an aerosol generating material and a tobacco material;

a third portion comprising a cooling material; and a fourth portion comprising a filter material, wherein the first portion, the second portion, the third portion, and the fourth portion are sequentially arranged along a longitudinal direction of the aerosol generating article, wherein the composite heat source comprises a combustible heat source and a combustible wick inserted into the combustible heat source, wherein, when the first portion is combusted, a combustion rate of the combustible wick is greater than a combustion rate of the combustible heat source, and the combustible wick that is combusted is removed such that an air flow passage is formed in a region in which the combustible wick has been removed, wherein the combustible wick comprises a first region and a second region, the first region and the second region being physically connected to each other, wherein the first region has a uniform diameter in the longitudinal direction of the aerosol generating article, and the second region has a diameter that increases as a distance away from the first region in the longitudinal direction of the aerosol generating article increases, the diameter of the second region being equal to or greater than the uniform diameter of the first region, and wherein the first region is an upstream in the aerosol generating article compared to the second region.

2. The aerosol generating article of claim 1, wherein the combustible wick comprises a combustible soaked with alcohol, a solid fuel, or a metal wire.

3. The aerosol generating article of claim 1, wherein the aerosol generating article further comprises a first wrapper surrounding the first portion and the second portion.

4. The aerosol generating article of claim 1, wherein the combustible wick is coaxially arranged in a central portion of the combustible heat source.

5. The aerosol generating article of claim 4, wherein the combustible wick comprises a magnesium ribbon.

6. An aerosol generating system, in which an aerosol is generated by ignition of the first portion of the aerosol generating article of claim 1.

7. The aerosol generating system of claim 6, wherein the combustible wick comprises a combustible body soaked with alcohol, a solid fuel, or a metal wire.

8. A composite heat source for an aerosol generating article, wherein the composite heat source comprises:

a combustible heat source; and a combustible wick inserted into the combustible heat source, wherein the combustible wick comprises a combustible body soaked with alcohol, a solid fuel, or a metal wire, wherein, when the combustible heat source is combusted, a combustion rate of the combustible wick is greater than a combustion rate of the combustible heat source, and the combustible wick that is combusted is removed such that an air flow passage is formed in a region in which the combustible wick has been removed, wherein the combustible wick comprises a first region and a second region, the first region and the second region being physically connected to each other, wherein the first region has a uniform diameter in a longitudinal direction of the aerosol generating article, and the second region has a diameter that increases as a distance away from the first region in the longitudinal direction of the aerosol generating article increases, the diameter of the second region being equal to or greater than the uniform diameter of the first region, and wherein the first region is an upstream in the aerosol generating article compared to the second region.

* * * * *